US007673405B2

(12) United States Patent
Guohong

(10) Patent No.: US 7,673,405 B2
(45) Date of Patent: Mar. 9, 2010

(54) ELECTRIC STEAM IRON

(75) Inventor: Fang Guohong, Zhouxiang (CN)

(73) Assignee: Yueli Electrical Appliance Co., Ltd., Ningbo, Zhejiang Province (CN)

( * ) Notice: Subject to any disclaimer, the term of this patent is extended or adjusted under 35 U.S.C. 154(b) by 0 days.

(21) Appl. No.: 12/138,059

(22) Filed: Jun. 12, 2008

(65) Prior Publication Data

US 2009/0000163 A1 Jan. 1, 2009

(30) Foreign Application Priority Data

Jun. 29, 2007 (CN) ..... 2007 1 0069806

(51) Int. Cl.
*D06F 75/18* (2006.01)
*D06F 75/26* (2006.01)

(52) U.S. Cl. ..... 38/77.83

(58) Field of Classification Search ..... 38/74, 38/77.1, 77.7–77.83, 82; 219/245, 250–255; 417/410.1, 415
See application file for complete search history.

(56) References Cited

U.S. PATENT DOCUMENTS 1,736,148 A * 11/1929 Brewer ..... 38/77.7
1,840,652 A * 1/1932 Bell ..... 219/252
2,345,413 A * 3/1944 Morton ..... 38/77.7
2,350,452 A * 6/1944 Envall ..... 38/77.83
3,110,975 A * 11/1963 Kircher ..... 38/77.7
3,263,350 A * 8/1966 Abraham ..... 38/77.7
4,406,591 A * 9/1983 Louis ..... 417/363
5,279,054 A * 1/1994 Chasen ..... 38/77.7
6,438,876 B2 * 8/2002 Har et al. ..... 38/77.7
6,953,912 B2 * 10/2005 Alday Lesaga ..... 219/251
7,472,504 B2 * 1/2009 Yu et al. ..... 38/77.8

FOREIGN PATENT DOCUMENTS

CN 2820934 9/2006
WO 2007/085145 8/2007

* cited by examiner

*Primary Examiner*—Ismael Izaguirre
(74) *Attorney, Agent, or Firm*—Richard M. Goldberg

(57) ABSTRACT

An electric steam iron includes a water tank, a bottom plate, a heating device which is used to heat the bottom plate, a steam generator having a boiling chamber, a heating device to heat the boiling chamber and a temperature controller, with the inlet of the boiling chamber being in fluid communication with the water tank and the outlet of the boiling chamber being in fluid communication with the outlet opening of the bottom plate. The heating devices of the bottom plate and the steam generator are connected in series with their respective heating circuit, so that there is sole control of the steam generator, such that when using the iron again, it can spray steam directly without warming up the steam generator, thereby eliminating the warming up time of the steam generator and greatly speeding up boiling of the water.

7 Claims, 5 Drawing Sheets

ELECTRIC STEAM IRON

BACKGROUND OF THE INVENTION

The present invention relates to an electric steam iron for domestic use.

Known electric steam irons mainly comprise a housing, a water tank, a bottom plate and a heating device which is used to heat the bottom plate. A boiling chamber is provided inside the bottom plate, whereby the water can be heated up and boiled by the bottom plate, so that the boiling chamber in the bottom plate forms a steam generator. When the iron is working, the water in the boiling chamber is heated by the bottom plate and turns to steam, and this can then be sprayed out from the steam outlet of the bottom plate to iron the clothing. However, since all the heat to boil the water is supplied by the bottom plate which is also used as the ironing part, the temperature of the bottom plate cannot be so high during the ironing operation, and in addition, the temperature will therefore sometimes decrease when the bottom plate contacts outside objects, both of which will result in part of the steam changing into water drops, which have an impact on the ironing effect. Therefore, some new irons with independent steam generators relative to the bottom plate have been provided to solve this problem. For example, Chinese Patent Application No. 02152250.2, entitled "A Bottom Plate on the Steam Iron for Home Use," is an example of such technology. The steam iron in that invention comprises a bottom plate, a heating device to heat the bottom plate, a temperature controller on the surface of the bottom plate and an independent steam generator above the bottom plate, and the steam generator includes an independent boiling chamber, a heating device to heat the boiling chamber and a temperature controller on the surface of the boiling chamber. The inlet of the boiling chamber communicates with the water tank, and the outlet of the boiling chamber communicates with the outlet opening in the bottom plate.

The known electric steam iron generally includes only one heating circuit to provide power to the heating device on the bottom plate, and includes only two switches. One switch is used to control the entire operation of the iron, that is, the power switch which provides power to the heating device in the bottom plate, and which is also a knob switch that is united with the adjusting switch of the temperature controller of the bottom plate, whereby the latter switch can select the corresponding temperature according to the material of the clothing that needs to be ironed. The other switch is used to control exhausting of steam. In operation, once the power switch of the electric iron is turned off, the boiling chamber inside the bottom plate will cool down, and it is necessary for the cool boiling chamber to be heated again in order for the steam generator to restart to work. Then the heating device should warm up the boiling chamber. However, this will cost a lot of time. Therefore, when the user needs to iron a passel of clothes, the electric iron is in a discontinuous state of use. It is therefore power-consuming to turn on the switch all the time, and it is time-consuming to turn off the switch when not in use, since time is needed to warm up the boiling chamber. Therefore, this arrangement is not suitable for practical use.

Regarding the electric steam iron of the Chinese patent mentioned above, if both the independent steam generator and the heating device in the bottom plate are powered and controlled by the same heating circuit, this will not be suitable for use either since it will produce the same problems as the existing electric steam iron.

SUMMARY OF THE INVENTION

It is an object of the present invention to provide an electric steam iron which can reduce the time to warm up the steam generator and expedite the boiling speed of the water.

For achieving this object, the electric steam iron of the present invention comprises a water tank, a bottom plate, a heating device which is used to heat the bottom plate, a temperature controller on the surface of the bottom plate and a steam generator above the bottom plate. The steam generator includes a boiling chamber, a heating device to heat the boiling chamber and a temperature controller on the surface of the boiling chamber, while the inlet of the boiling chamber is in fluid communication with the water tank and the outlet of the boiling chamber is in fluid communication with the outlet opening of the bottom plate. The power of the heating devices of both the bottom plate and the steam generator are provided by heating circuits. However, there are two independent heating circuits, and the heating device of the bottom plate and the heating device of the steam generator are connected in series with their respective heating circuit.

These two independent heating circuits can respectively have independent switches to solely control the work of the bottom plate and the steam generator. To make the structure simpler, and reduce manufacture difficulties, the switching on/off of the heating circuit which is connected in series with the heating device of the bottom plate can still be controlled by the knob switch just as with a known electric steam iron, and the heating circuit which is connected in series with the heating device of the steam generator can directly be connected with the power line of the electric steam iron. Then, if the power line of the electric steam iron is switched on, the steam generator can start to work.

The heating device used to heat the bottom plate and the steam generator can be any type of existing heater. However, in order to make the structure simpler and to assure the efficiency of generating steam of the steam generator, the heating device of the bottom plate and the heating device of the steam generator are preferably an electrothermal tube or a PTC (Positive Temperature Coefficient) heater.

In order to improve the effect of boiling of the water by the steam generator, a winding water passage winds back and forth in the boiling chamber of the steam generator. By increasing the distance the water needs to pass, the area of the water touching the steam generator is increased too, so that the effect of boiling water can be improved.

In order to make a further improvement of the effect of boiling water, a plurality of barrier pieces can be provided on the inner wall of the water passage, to further increase the area of the water touching the steam generator, so that the effect of boiling water can be further improved.

The steam generator is independent relative to the bottom plate so that it is not effected by the temperature of the bottom plate. In this regard, the steam generator is completely segregated from the bottom plate. Further, a heat insulation cover is provided to cover the steam generator, in order to segregate the steam generator, whereby the steam generator will achieve better heat insulation segregated from the bottom plate. This will reduce the interaction of these two devices, and prevent the strong heat of the steam generator from transferring to other devices in the iron. It will also reduce the temperature of the housing of the iron, so that the user will not be scalded when using it.

In order to better control the infusion of the water in the water tank to the steam generator, an electromagnetic pump is provided in the iron, and the inlet of the boiling chamber is in fluid communication with the water tank via the electromagnetic pump. A filter tip is provided at the inlet of the electromagnetic pump to filter impurities in the water and eliminate any bad effect on the electromagnetic pump and steam generator by reason of such impurities.

Compared with the prior art, in the present invention, there are two independent heating circuits to respectively provide power to the heating device of the bottom plate and the heating device of the steam generator. As a result, sole or independent control of the steam generator can be provided, rendering control to the power of the iron more convenient and flexible, and which better adapts to the demand of discontinuous work of the iron. Therefore, by making the heating circuit of the steam generator electric, when the iron is used again, it can spray steam directly without warming up the steam generator. This eliminates the warming up time of the steam generator and greatly speeds up the boiling of the water. This is very practical for ironing of mass clothing. Further, the heat insulation covering the steam generator can separate the steam generator from the outside, and prevent the steam generator from heat transfer with the outside. This will reduce the temperature of the housing of the iron, as well as protect it from being effected by the temperature of the bottom plate. The structure of this invention is simple and the actual effect of ironing is excellent, and it is can be easily manufactured.

DETAILED DESCRIPTION

Figure 1:
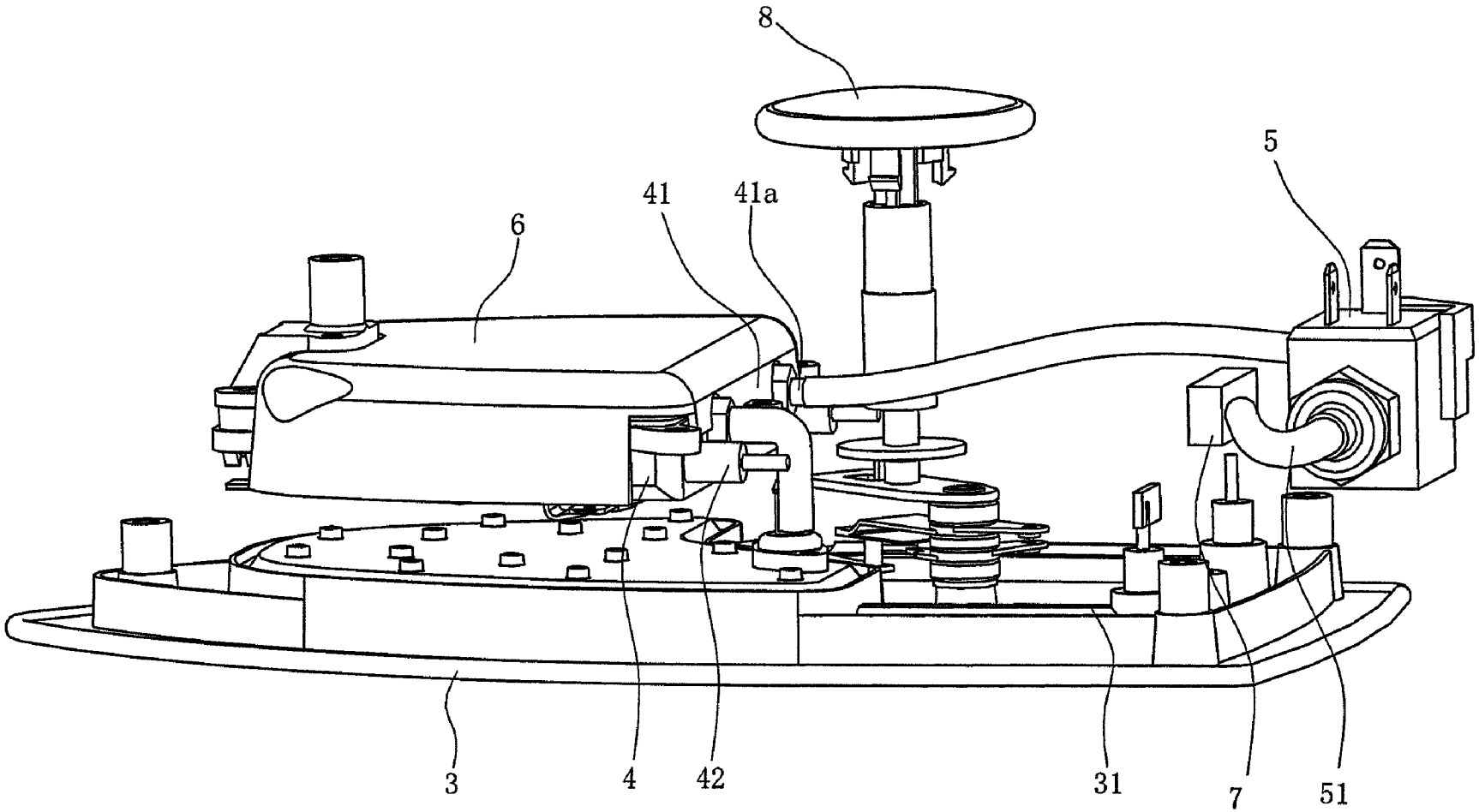
FIG. 1 is a perspective view of the electric steam iron of the present invention, with the housing and some minor devices and lines of linking removed.
Figure 2:
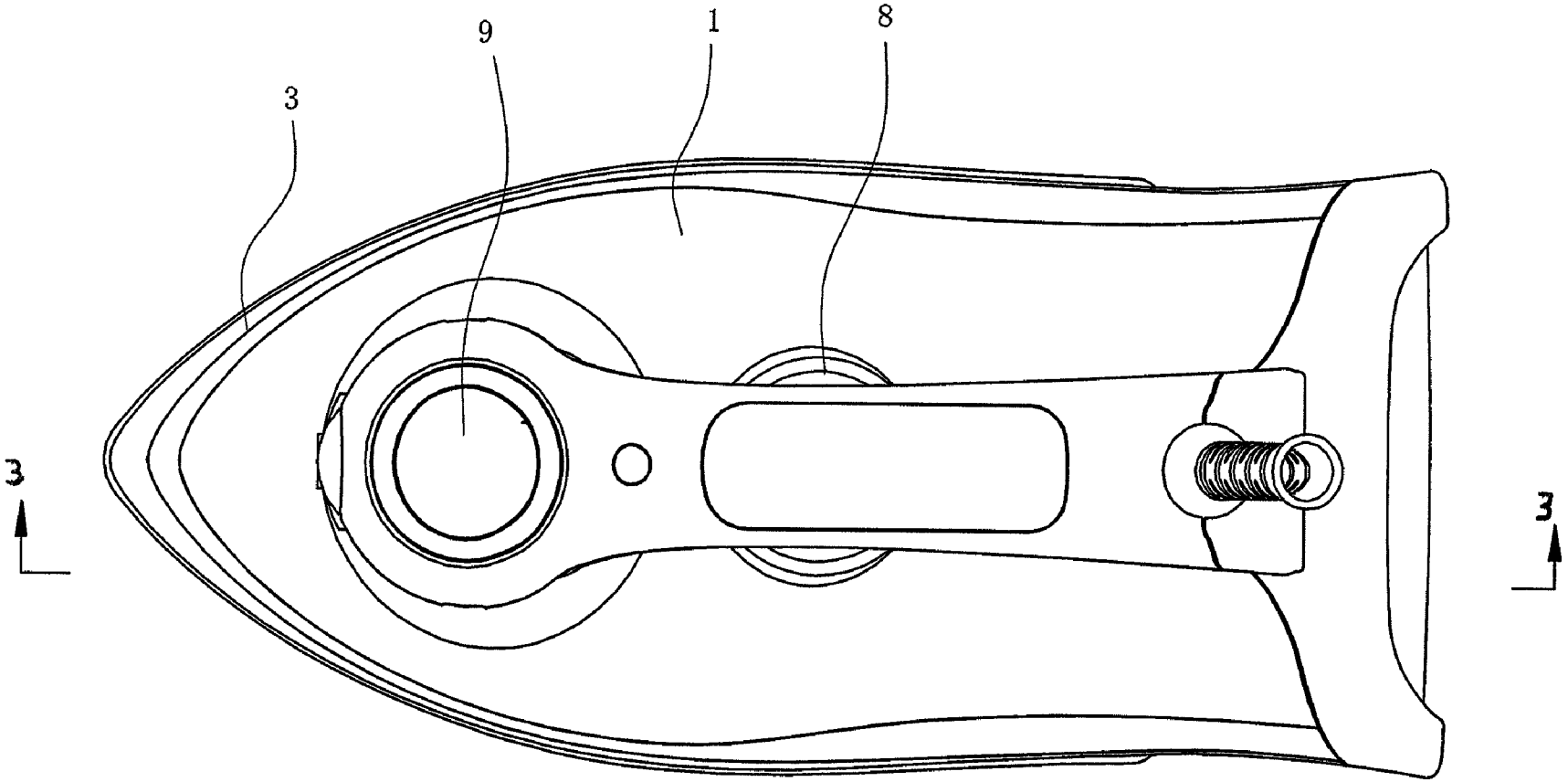
FIG. 2 is a top plan view of the electric steam iron of the present invention.
Figure 3:
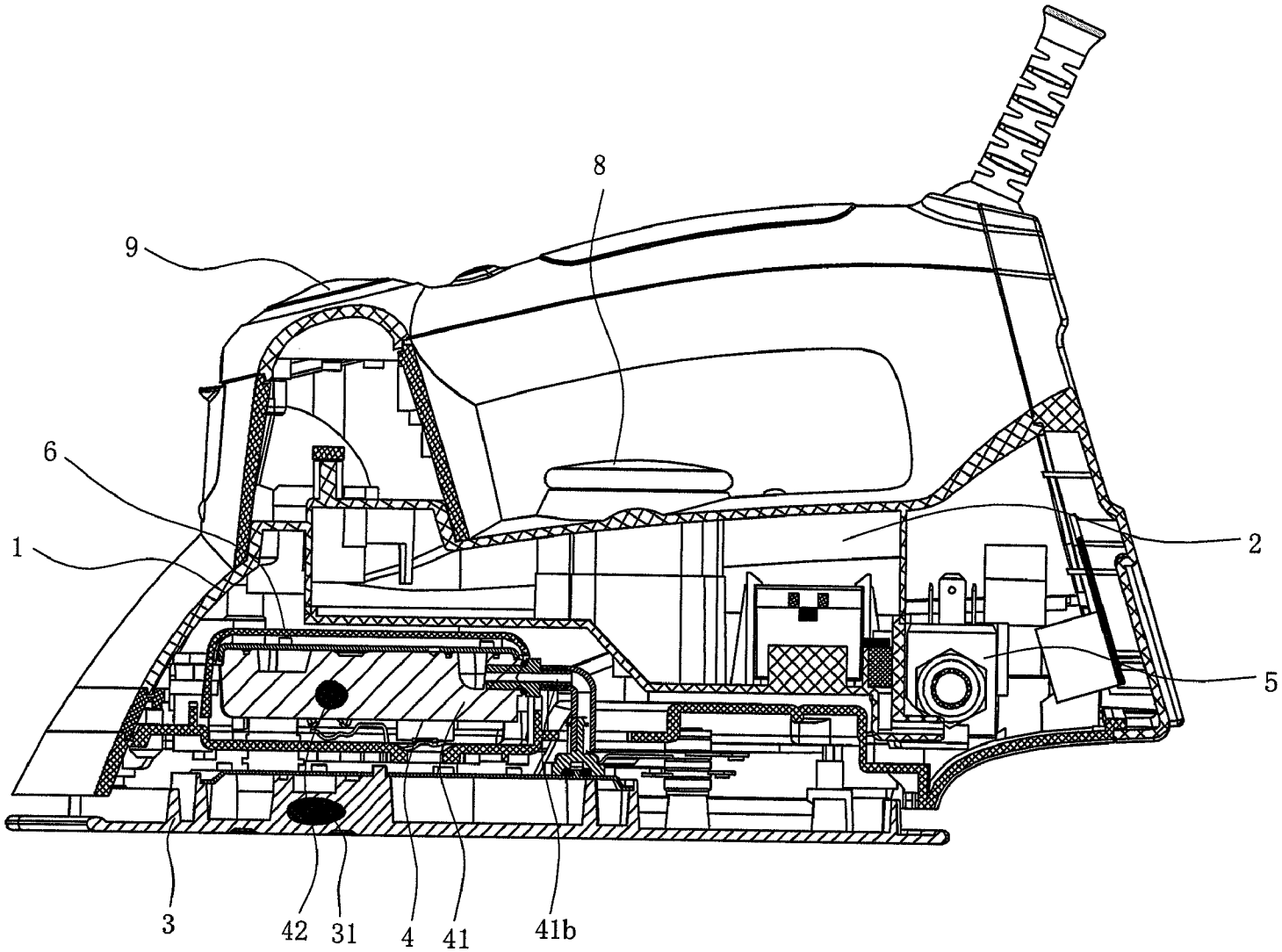
FIG. 3 is a sectional view of FIG. 2, taken along line 3-3 thereof.

To enable a further understanding of the innovative and technological content of the invention herein, reference is made to the detailed description of the invention and the accompanying drawings below.

FIGS. 1~5 show the embodiment of the present invention. In this embodiment, the electric steam iron comprises a housing (1), a water tank (2), an electromagnetic pump (5), a bottom plate (3) including a heating device (31) which is used to heat the bottom plate (3), a temperature controller (T2) on the surface of the bottom plate (3) and a steam generator (4) above the bottom plate (3). The steam generator (4) includes a boiling chamber (41), a heating device (42) to heat the boiling chamber (41) and a temperature controller (T1) on the surface of the boiling chamber (41).

The housing (1) is made up of a thin plate or many pieces of lamella as required by the actual manufacture. The water tank (2) is enclosed by the housing (1), and is formed as a closed chamber above the bottom plate (3) and the steam generator (4). This is similar to an existing opening-style electric steam iron.

The water tank (2) is in fluid communication with the inlet (41*a*) of the boiling chamber (41) of the steam generator (4) via the electromagnetic pump (5). Specifically, the inlet (51) of the electromagnetic pump (5) is in fluid communication with the water tank (2), and the outlet of the electromagnetic pump (5) is in fluid communication with the inlet (41*a*) of the boiling chamber (41). The electromagnetic pump (5) can be directly fixed on the housing (1). To avoid impurities from entering into the water passage, a filter tip (7) is provided at the inlet (51) of the electromagnetic pump (5). The outlet (41*b*) of the boiling chamber (41) of the steam generator (4) communicates with an outlet opening of the bottom plate (3).

At the same time, a heat insulation cover (6) covers the steam generator (4), and thereby segregates the steam generator (4) from the outside and has a heat insulation effect.

Figure 4:
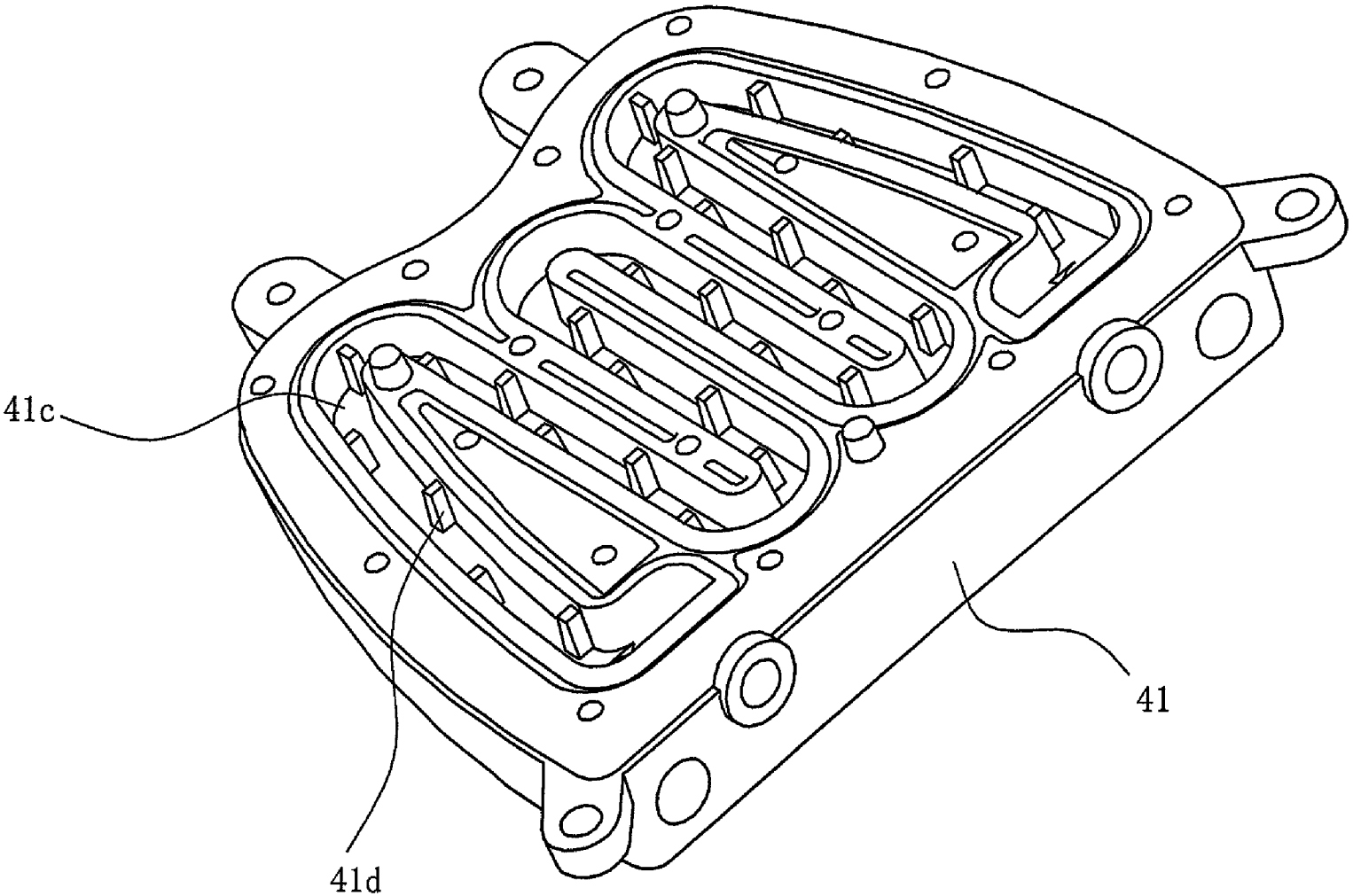
FIG. 4 is a perspective view of the boiling chamber of the steam generator of the present invention, with the cover of the boiling chamber removed.

A winding water passage (41*c*) winds back and forth in the boiling chamber (41) of the steam generator (4). There are a plurality of barrier pieces (41*d*) on the inner wall of the water passage (41*c*) which also wind back and forth with the passage (41), as shown in FIG. 4.

Both the heating device (31) in the bottom plate (3) and the heating device (42) in the steam generator (4) are each preferably an electrothermal tube, but may be a PCT (positive temperature coefficient) heater.

Figure 5:
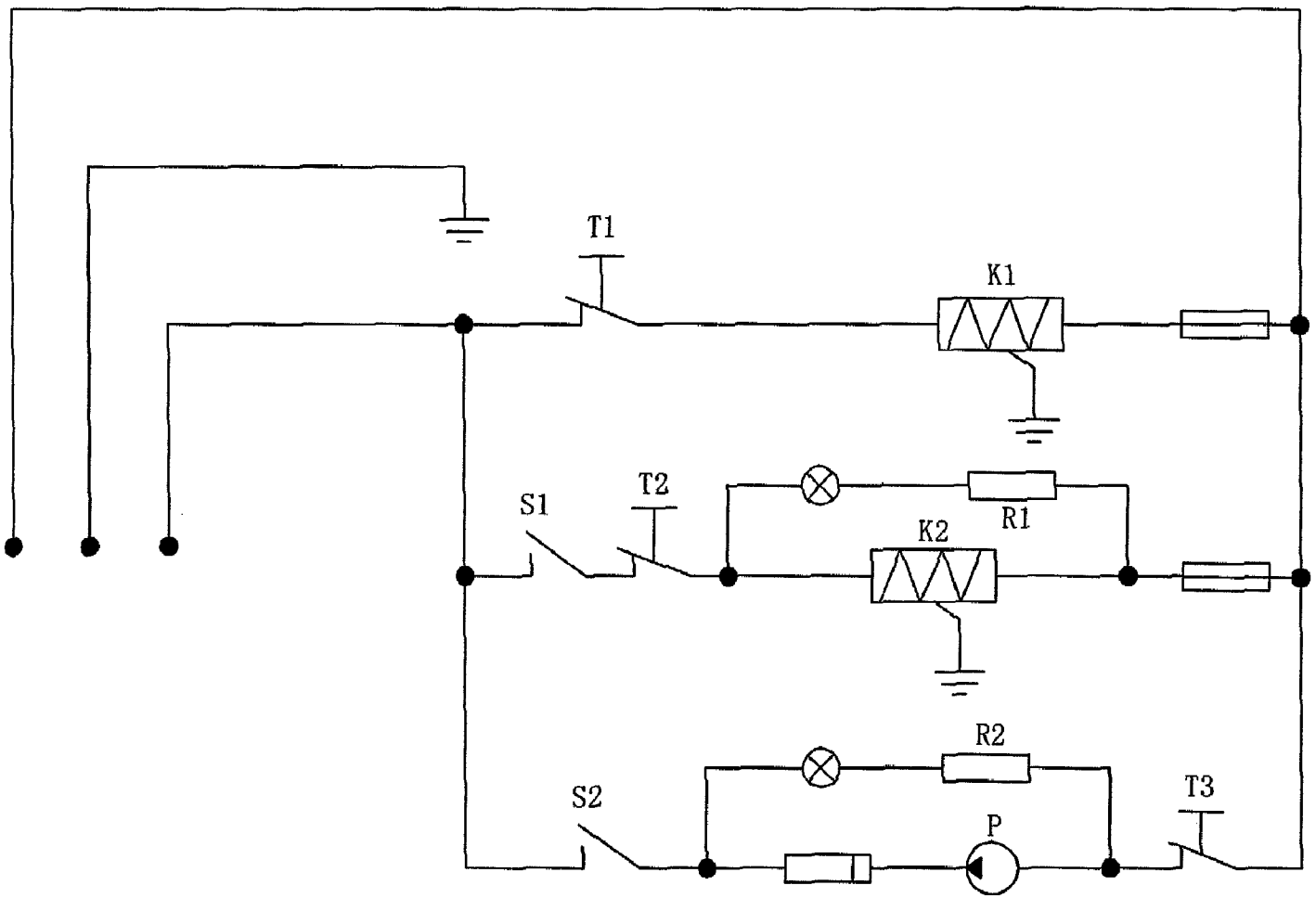
FIG. 5 is a circuit diagram showing the electrical connections of the elements of the present invention.

FIG. 5 shows the electrical connections of the element in the electric steam iron of the present invention, except for the working circuit of the electromagnetic pump (5) which is designated as P in FIG. 5. In the electric steam iron, there are two independent heating circuits which respectively provide power to the heating device (31) (designated by K2 in FIG. 5) of the bottom plate (3), and to the heating device (42) (designated by K1 in FIG. 5) of the steam generator (4). The heating device (31) of the bottom plate (3) and the heating device (42) of the steam generator (4) are each connected in series with their respective heating circuits. R1 and R2 are resistances and S1 and S2 are switches.

In a known electric steam iron, a knob switch is provided, which is a switch that is united with a switch to control the heating device (31) of the bottom plate (3) and an adjust switch to adjust the working temperature of the temperature controller (T2) on the bottom plate (3).

In the present invention, the switching on/off of the heating circuit which is connected in series with the heating device (31) of the bottom plate (3) is controlled by the knob switch (8), and the heating circuit which is connected in series with the heating device (42) of the steam generator (4) is directly connected with the power line of the electric steam iron. In other words, the heating device (31) of the bottom plate (3) is controlled by the knob switch (8), and the heating device (42) of the steam generator (4) is controlled to work by power being switched on or off.

A button (9) (designated by S2 in FIG. 5) is provided on the housing (1) and controls the electromagnetic pump (5).

The third temperature controller (T3) in FIG. 5 shuts the circuit of the electromagnetic pump (5) when the temperature of heating device (42) of the steam generator (4) is too low, to prevent the electromagnetic pump (5) from operating. In other words, this is provided in order to avoid the electromagnetic pump (5) still continuously pumping the water into the boiling chamber (41) of the steam generator (4) when the steam generator (4) is not operating, and to also protect the electric steam iron as well.

What is claimed is:

1. An electric steam iron comprising:

a water tank, a bottom plate having an outlet opening, a heating device in the bottom plate for heating the bottom plate, a temperature controller on the surface of the bottom plate, a steam generator above the bottom plate, the steam generator having a boiling chamber, a heating device to heat the boiling chamber and a temperature controller on a surface of the boiling chamber, the boiling chamber having an inlet in fluid communication with the water tank, an outlet in fluid communication with the outlet opening of the bottom plate, a first heating circuit for providing power to the heating device of the bottom plate, the heating device of the bottom plate being connected in series with the first heating circuit, a second independent heating circuit for providing power to the heating device of the steam generator, the heating device of the steam generator being connected in series with the second heating circuit, an electromagnetic pump interposed between the water tank and the boiling chamber, the electromagnetic pump having an inlet in fluid communication with the water tank and an outlet in fluid communication with the inlet of the boiling chamber, and a temperature controller connected with the electromagnetic pump to shut off the electromagnetic pump when the temperature of the heating device for heating the boiling chamber of the steam generator is at a predetermined low level, to prevent the supply of water to the steam generator when the steam generator is not operational.

2. An electric steam iron according to claim 1, further comprising a knob switch for switching on and off the first heating circuit, and wherein the second heating circuit is directly connected with a power line of the electric steam iron.

3. An electric steam iron according to claim 1, wherein the heating device of the bottom plate and the heating device of the steam generator are each one of the following:

an electrothermal tube, and a positive temperature coefficient heater.

4. An electric steam iron according to claim 1, wherein said boiling chamber of said steam generator has a winding water passage.

5. An electric steam iron according to claim 4, further comprising a plurality of barrier pieces on an inner wall of said water passage.

6. An electric steam iron according to claim 1, further comprising a heat insulation cover for the steam generator.

7. An electric steam iron according to claim 1, further comprising a filter at the inlet of the electromagnetic pump.

* * * * *